US005362150A

United States Patent [19]

Taylor

[11] Patent Number: 5,362,150

[45] Date of Patent: Nov. 8, 1994

[54] FLUID MIXER

[75] Inventor: William D. Taylor, Sandy Hook, Conn.

[73] Assignee: Hughes Aircraft Company, Los Angeles, Calif.

[21] Appl. No.: 986,650

[22] Filed: Dec. 8, 1992

[51] Int. Cl.[5] ..... B01F 5/04

[52] U.S. Cl. ..... 366/173; 366/174; 366/336

[58] Field of Search ..... 138/37, 40, 42, 39; 366/154, 173, 174, 176, 177, 336, 337, 340, 171, 172, 107

[56] References Cited

U.S. PATENT DOCUMENTS

| | | | |
|---|---|---|---|
| 1,043,644 | 11/1912 | Thomas | 366/174 |
| 2,965,695 | 12/1966 | Sleicher | 366/336 |
| 3,918,687 | 11/1975 | Hubers | 366/154 |
| 4,428,679 | 1/1984 | Fischer | 366/154 |
| 5,011,293 | 4/1991 | Roop | 366/173 |
| 5,074,671 | 12/1991 | Roueche | 366/173 |
| 5,082,372 | 1/1992 | Robinson | 366/174 |

FOREIGN PATENT DOCUMENTS

| | | | |
|---|---|---|---|
| 666515 | 5/1933 | Germany | 366/173 |

*Primary Examiner*—Timothy F. Simone
*Assistant Examiner*—Terrence R. Till
*Attorney, Agent, or Firm*—M. E. Lachman; M. W. Sales; E. K. Denson-Low

[57] ABSTRACT

A fluid mixer has a plurality of inlet conduits extending into a chamber and being directed toward a common location on a first surface of the chamber.

13 Claims, 2 Drawing Sheets

FLUID MIXER

BACKGROUND OF THE INVENTION

The present invention generally relates to a fluid mixer and, in particular, relates to one such fluid mixer having a plurality of fluid inlet conduits terminating proximate a first surface of a chamber such that fluids exiting the conduits impinge upon a single location of the first surface.

As used herein the term fluid and the derivatives thereof will be taken to include liquids, gases supercritical fluids and generally all flow compatible areas defined by a typical thermodynamic state diagram. However, for the sake of consistency and by way of example only, the following description will primarily refer to gases.

There are many instances, such as the precise plasma etching of a substrate, wherein the composition of a gas is required to be highly uniform over an extended period of time. In most instances, however, the gas is a mixture of a number of different gases. Thus, a gas mixer is frequently introduced into the gas delivery system. However, it has been found that most conventional gas mixers do not thoroughly mix gases. Typically, these conventional gas mixers can be categorized as either the manifold type or the expansion chamber type.

In general, the manifold type of gas mixer usually include a straight tube having a plurality of inputs and a single output located distal the inputs. In most manifold designs, the straight tube has a sealed end(s) to force the gases toward the output. The primary disadvantage of the manifold gas mixer is that for gases having different flow velocities, hence, different densities for constant tube diameters, the flow in the manifold may readily become stratified rather than mixed.

The expansion chamber type of gas mixer usually includes a plurality of inlet conduits on one wall thereof and a single outlet conduit on the opposing wall. The principle of the expansion chamber gas mixer is to allow the incoming gases to expand such that the forward flow velocity of the incoming gas is substantially reduced, preferably to close to zero forward velocity. In this manner the incoming gases expand and simultaneously mix. However, this type of gas mixer is disadvantageous since the actual mixing of the gases is substantially uncontrolled.

Consequently, it will be readily understood that there is a great need and desire for a fluid mixer that reliably and controllably mixes a plurality of fluids such that the output mixture thereof is uniform.

SUMMARY OF THE INVENTION

Accordingly, it is one object of the present to provide a fluid mixer that overcomes the above-recited drawbacks of conventional fluid mixers.

This object is accomplished, at least in part, by a fluid mixer having a plurality of inlet conduits extending into and being directed toward one location of a surface of a chamber.

Other objects and advantages of the present will become apparent to those skilled in the art from the following detailed description read in conjunction with the appended claims and the drawing attached hereto.

BRIEF DESCRIPTION OF THE DRAWING

The drawing, not drawn to scale, includes.

DETAILED DESCRIPTION OF THE INVENTION

Figure 1:
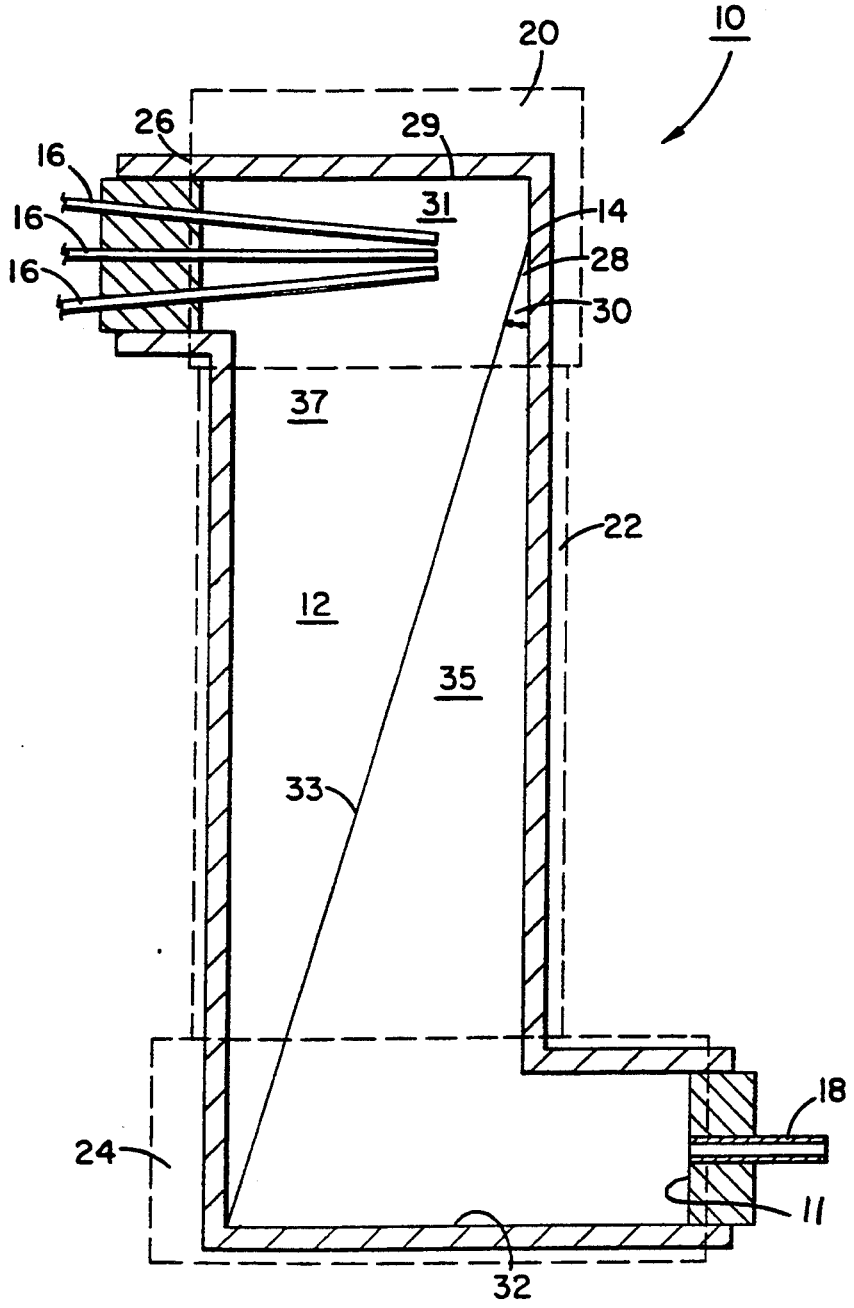
FIG. 1, which is a cross-sectional view of a fluid mixer embodying the principles of the present invention.

A fluid mixer, generally indicated at 10 in FIG. 1 and embodying the principles of the present invention, includes a chamber 12 having a first surface 14 disposed opposite a plurality of input conduits 16. In addition, the mixer 10 includes a fluid outlet conduit 18 disposed distal and opposite to the inlet conduits 16.

It will be understood that while a single chamber 12 is contemplated herein, for the purpose of description, the chamber 12 will be discussed as if it were a number of overlapping sections wherein various physical mixing reactions occur. More specifically, as shown by the dashed lines in FIG. 1, the chamber 12 is described herein as having a fluid entry section 20, a fluid expansion section 22, and a fluid exit section 24.

In the preferred embodiment, the plurality of inlet conduits 16 enter through one end 26 of the fluid entry section 20 of the chamber 12 and are directed toward a single location 28 on the opposing first surface 14 of the chamber 12. The inlet conduits 16 are disposed to ensure that the gas inlet conduits 16 are directed toward the single location 28 and are spaced away from that surface 14 a distance that is less than four times the diameter of the conduits. Preferably, if the inlet conduits are of different diameters, the distance therefrom to the single location 28 should be less than four times the inner diameter of the smaller conduit. By this spacing, each gas stream from each of the inlet conduits 16 does not significantly expand prior to impinging upon the single location 28 on the opposing first surface 14. As a result, the streams of gas begin mixing as they converge together toward the single location 28 on the opposing first surface 14.

Upon impinging at the first surface 14, the mixed or combined gas stream forms a jet stream that expands directly into a first portion 35 of the fluid expansion section 22. It will be understood that, in practice, the jet stream expands in all directions from the first surface 14. However, since the surrounding walls 29 defining the chamber 12 prevent continued expansion in those directions, a substantial portion of the jet expands into the expansion section 22 as a jet. As more fully discussed below, another portion of the expanding jet expands into the confined areas 31 of the fluid entry section 20 and further assists the mixing of the gases. In general, the gas stream impinging upon the solid first surface 14 expands therefrom at an angle 30 of about 7° into the fluid expansion section 22. The expanding stream is depicted in FIG. 1 as expanding into the first portion 35 of the fluid expansion section 22. It will be understood that the deflection of a fluid jet is taken to define the turning of the jet from the point of stagnation into an expansion stream. As the jet expands, the flow within the wake of the jet becomes very turbulent, thereby more thoroughly mixing the gases. As the flow of mixing gases continues to expand, the portion of the gas mixture that expands into the confined areas 31 of the fluid entry section 20 flow into the void areas 37 of the fluid expansion section 22 thereby establishing a quasi-stable jet having a larger relative velocity than the jet expanding into the portion 35 of the fluid expansion section 22. As a result, the friction created by the different velocities causes further mixing. More specifically, the portions of the gas jet that expands into the void areas 37 of the expansion section 22 creates a diffusion boundary 33 with the jet. In addition, as the jet expands, the translational velocity of the gas streams decreases thereby allowing gases that may initially have different flow velocities to be more thoroughly mixed as the translation velocity approaches zero. Hence, the fluid mixer 10 of the present invention ensures the thorough fluid mixing independent of the flow velocities of the incoming fluids.

The expanding gas stream impinges upon a wall 32 of the exit section 24 that, in the preferred embodiment, is disposed in the path of the expanding stream and in a plane perpendicular to the plane of the first surface 14. The wall 32 is located away from the first surface 14 a distance such that the expanding stream has a minimum velocity and, as a result, the expansion type mixing effect is fully utilized. The mixed gas, upon impinging on the exit section 24, is reaccelerated, again at an angle of about seven degrees, toward the outlet conduit 18 that is disposed, in the preferred embodiment, in a second surface which is in a plane substantially parallel to the plane of the first surface 14. Further, the outlet conduit 18 is longitudinally displaced in a direction opposite to the inlet conduits 16 with respect to the plane of the first surface 14 by the distance required to expand the gas flow across the cross-sectional area of the expansion section 22 of the chamber 12. Preferably, although by no means necessary, in one embodiment the outlet conduit 18 has the same diameter as one of the inlet conduits 16. In fact, the inside diameter of the outlet conduit 16 can be chosen to control the flow velocity of the mixed gas. The fluid exit section 24 of the chamber 12 thus has a length such that when the expanding gas stream impinges thereon, the entire cross-sectional portion thereof is filled.

It will be recognized that by the arrangement of the fluid mixer 10 a multiplicity of inputted gases or fluids is subjected to five distinct mixing stages. The first mixing stage being the convergence of the gases from the ends of the inlet conduits 16 as the fluid streams move toward the same location 28 on the first surface 14 of the entry section 20 of the chamber 12. The second mixing stage occurring at the location 28 where all conduit streams are directed and therefore turbulent flow causes further mixing as the gas streams which, at this point, is effectively a single gas stream that expands from the location 28 on the surface 14 at an angle of about 7° into the expansion section 22 of the chamber 12. The third mixing stage occurs within the expansion section 22 of the chamber 12 as the mixed gas expands toward the exit section 24 of the chamber 12. The fourth mixing stage occurs when the gas flow with a minimal velocity impinges upon the wall of the exit chamber, and the fifth mixing stage occurs within the exit chamber where the gas stream, expanding from the exit section wall, mixes and expands into the exit section. It will be understood that although five mixing action have been specifically related, other mixing actions, such as the mixing along the jet boundary 33 also occur.

In one particular embodiment, the chamber 12 is circular in cross-section although any cross-sectional shape can be used, In this embodiment, the length of the expansion section 22 of the chamber 12 is determined by the diameter of the chamber 12 and the fact that the gas stream reflects from the first surface 14 at 7°. That is, recognizing the angle of expansion of the jet, the length of the expansion section 22 is selected to ensure that the jet expands to fill the cross-sectional area of the expansion section 22 and provides a minimal translational velocity at the wall 32 or the exit section 24.

In one particular embodiment, the chamber 12 can be formed by the use of conventional tube, pipe or gas fittings. For example, the fluid entry section 20 and the fluid exit section 24 can be right angled fittings and the expansion section 22 can be a straight length of tubing. Alternatively, the fluid entry section 20 and the fluid exit section 24 can be fight angled fittings with the outside diameter of the exit section 24 being chosen to fit into the inside diameter of the fluid entry section 22 whereby the fluid expansion section 22 is formed by joining the two fittings.

It will be understood by those skilled in the art that depending on the diameter of the chamber 12, the diameter of the inlet conduits 16, and the number of fluids to be uniformly mixed, that a single fluid mixer 10 may not meet the requirements of a particular system. However, as more fully discussed below, the system 34, shown in FIG. 2, and embodying the principles of the present invention can be implemented to provide a uniform fluid mixture for most, if not all, systems.

Figure 2:
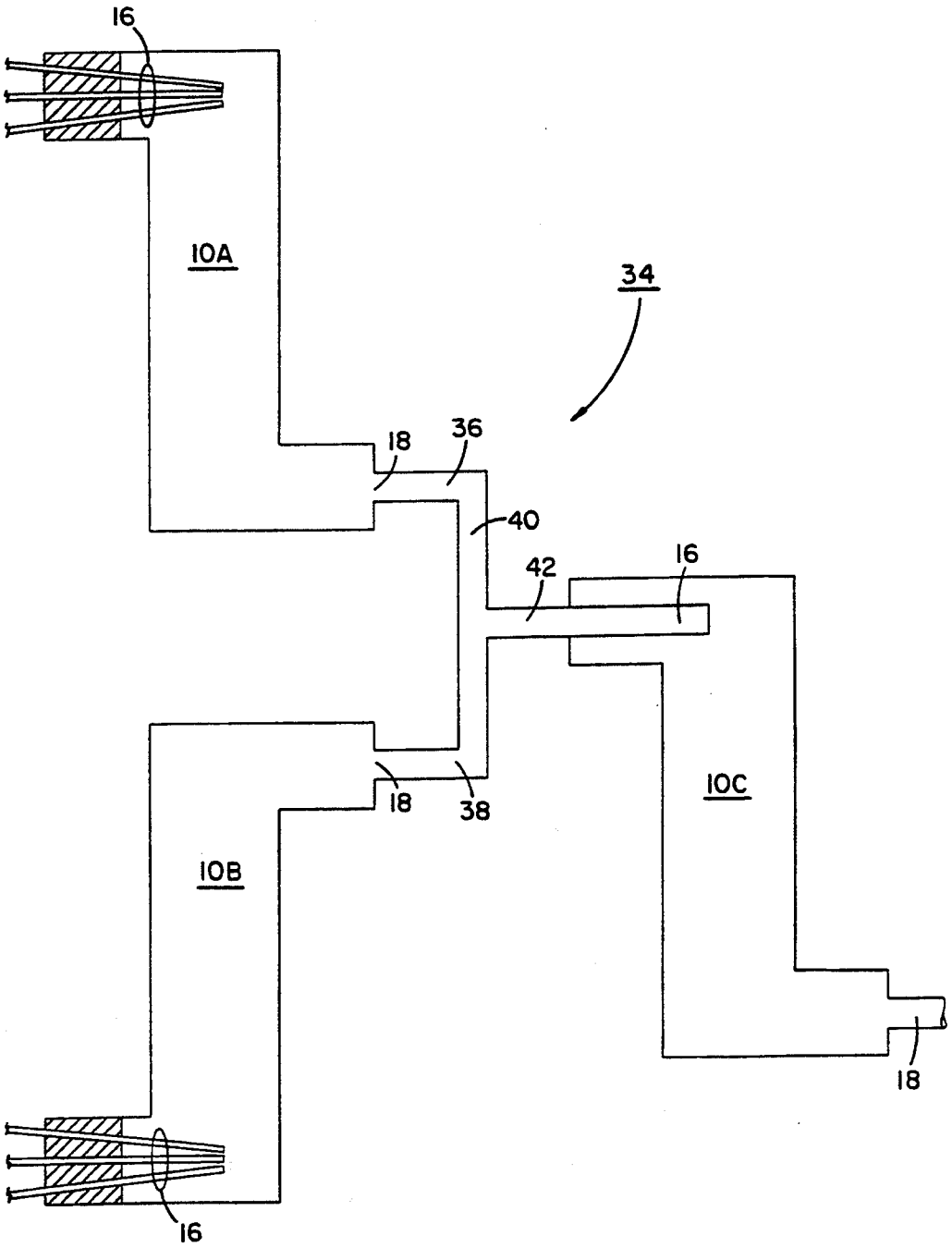
FIG. 2, which is a schematic diagram of a system particularly adapted for mixing a plurality of fluids and embodying the principles of the present invention.

As shown in FIG. 2, wherein elements common to the fluid mixer 10 in FIG. 1 are identified with the same numerals, the system 34 includes a plurality of fluid mixers, 10A, 10B, and 10C each having a plurality of inlet conduits 16 and a single outlet conduit 18. In this particular system, the outlet conduits 18 of the two fluid mixers, 10A and 10B, are interconnected to the inputs 36 and 38 of a "T" fitting 40. The output 42 of the "T" fitting 40 serves as the inlet conduit 16 of the fluid mixer 10C. Hence, the mixed gases from the fluid mixers, 10A and 10B, are directed into the third fluid mixer 10C. In this embodiment, the third fluid mixer 10C has a single inlet conduit 16. It will be understood, however, that the outlet conduits 18 of each of the fluid mixers, 10A and 10B, could become a single inlet conduit 16 of the fluid mixer 10C. Alternatively, it will be recognized that the number of fluid mixers in any particular system is dependent, inter alia, upon the number of gases to be mixed as well as the number of inlet conduits each fluid mixer 10 can practically sustain. It is contemplated, of course, that the fluid miser 10 can be appropriately cascaded to provide the uniform mixing of any number of gases.

Although the present invention has been described with respect to particular embodiments, it will be understood by those skilled in the art that other arrangements and configurations may also be made that nonetheless fall within the spirit and scope of the present invention. Hence, the present invention is deemed limited only by the appended claims and the reasonable interpretation thereof.

What is claimed is:

1. A fluid mixer comprising a chamber comprising:

(a) a fluid entry section having a plurality of inlet conduits extending into said fluid entry section wherein all of said inlet conduits are directed toward a common location on a first planar surface of said fluid entry section and said fluid enters said fluid entry section through said inlet conduits;

(b) a fluid expansion section contiguous with said fluid entry section wherein said fluid from said fluid entry section expands; and (c) an exit section contiguous with said fluid expansion section having an outlet conduit disposed therein in a second planar surface thereof which is substantially parallel to said first surface of said fluid entry section wherein said fluid from said fluid expansion section enters said exit section and exits therefrom through said outlet conduit.

2. The fluid mixer as claimed in claim 1, wherein said inlet conduits extend toward said first surface to within a distance of less than four times the diameter of the inside diameter of one of said conduits.

3. The fluid mixer as claimed in claim 2 wherein at least two of said inlet conduits have different inside diameters and said distance is less than four times the diameter of the smaller of the two inside diameters.

4. The fluid mixer as claimed in claim 2, wherein said fluid mixer has a circular cross-section.

5. The fluid mixer as claimed in claim 1 wherein said fluid expansion section has a length such that said fluid from said fluid entry section expands across the cross-sectional area of said fluid expansion section.

6. The fluid mixer as claimed in claim 5 wherein said fluid exit section is substantially parallel to said fluid entry section and extends from said fluid expansion section in a direction opposite said fluid entry section.

7. The fluid mixer as claimed in claim 1 wherein said outlet conduit is substantially centered in the end of the fluid exit section.

8. The fluid mixer as claimed in claim 1 wherein said fluid exit section has a length substantially perpendicular to the length of the fluid expansion section such that the fluid from said fluid expansion section expands to fill the cross-sectional area of said fluid exit section.

9. A fluid mixing system, said system comprising:

(a) plurality of first fluid mixers wherein each said first fluid mixer comprises a chamber comprising:

(i) a fluid entry section having a plurality of inlet conduits extending into said fluid entry section wherein all of said inlet conduits are directed toward a common location on a first planar surface of said fluid entry section and said fluid enters said fluid entry section through said inlet conduits;

(ii) a fluid expansion section contiguous with said fluid entry section wherein said fluid from said fluid entry section expands; and (iii) an exit section contiguous with said fluid expansion section having an outlet conduit disposed therein in a second planar surface thereof which is substantially parallel to said first surface of said fluid entry section wherein said fluid from said fluid expansion section enters said exit section and exits therefrom through said outlet conduit;

(b) at least one second fluid mixer, said second fluid mixer having at least one inlet conduit extending into a second fluid mixer chamber and directed to a single location on a first surface of said second fluid mixer chamber; and (c) means for conveying the output from said first fluid mixers to said second fluid mixer.

10. The system as claimed in claim 9 wherein said output conveying means includes a "T" fitting, said "T" fitting having inputs being connected to said outlet conduits of said plurality of first fluid mixers and a single outlet communicating with said inlet conduit of said second fluid mixer.

11. The system as claimed in claim 9 wherein each outlet conduit of said plurality of first fluid mixers is an inlet conduit of said second fluid mixer.

12. The system as claimed in claim 16 wherein said inlet conduits of each of said plurality of first fluid mixers extend toward said respective first surface to within a distance of less than four times the diameter of the inside diameter of one of said inlet conduits.

13. The system as claimed in claim 12 wherein each outlet conduit of said plurality of first fluid mixers is equal to the inside diameter of one of the inlet conduits of said fluid mixer.

* * * * *